US005090370A

United States Patent [19]

Spada

[11] Patent Number: 5,090,370

[45] Date of Patent: Feb. 25, 1992

[54] BOILER TOP SUPPORT CASING CHANNEL SLIT RING

[75] Inventor: Ralph E. Spada, Canal Fulton, Ohio

[73] Assignee: The Babcock & Wilcox Company, New Orleans, La.

[21] Appl. No.: 724,258

[22] Filed: Jul. 1, 1991

[51] Int. Cl.[5] ..... F22B 37/24

[52] U.S. Cl. ..... 122/510; 29/890.03; 165/67

[58] Field of Search ..... 122/510; 165/162, 67; 110/336; 29/890.03

[56] References Cited

U.S. PATENT DOCUMENTS

| | | | |
|---|---|---|---|
| 1,104,144 | 7/1914 | Selden | 122/510 |
| 2,016,787 | 10/1935 | Liessenberg | 122/510 |
| 3,204,613 | 9/1965 | Smith | 122/510 |

*Primary Examiner*—Edward G. Favors

*Attorney, Agent, or Firm*—Robert J. Edwards; Michael L. Hoelter

[57] ABSTRACT

This invention pertains to a method of providing support for top boiler casing by partially slotting a channel or other bearing member and sliding a rod suspended from the top structural steel within this slot. Afterwards, a grooved plate is installed which is welded between the channel and the rod.

8 Claims, 2 Drawing Sheets

PRIOR ART

BOILER TOP SUPPORT CASING CHANNEL SLIT RING

FIELD OF THE INVENTION

This invention pertains to boiler construction in general, and more particularly to a method of supporting the inner penthouse casing from suspended rods.

BACKGROUND OF THE INVENTION

The general method of supporting the inner penthouse casing of a boiler is to suspend it from a series of threaded rods from top support steel. This inner boiler casing generally defines the boiler enclosure with insulation applied to the outer surface of the inner boiler casing. These threaded rods, with nuts, are hung from top structural steel and extend downward to but more generally through the upper or penthouse casing before terminating In most cases, these rods will be used to support an item within the boiler enclosure, thus the reason they often extend through the penthouse casing rather than terminate at the casing itself.

The casing itself is supported by or rests upon a series of channels that have small holes therein through which the rods pass. It is customary to weld a small ring between both the rod and the channel to secure the channel (and hence the casing) in place. Sometimes, this ring is a seal ring so as to prevent any flue gas from escaping from the boiler enclosure through this connection.

One difficulty with this method of installation is the fact that before anything else is supported from these rods, the intermediate channel must be installed and, in any event, well before the casing is to be inserted. Thus, the channels must be maneuvered to slide upward along the rods afterwhich they are temporarily field supported at a first location. Later, when it is time to install the casing, these channels must be detached from the temporary supports, re-maneuvered by sliding down the rods to their proper place. In addition to these redundant steps, the channels often are in the way or interfere with ongoing construction activities thus creating a hazard.

In the alternative, should the channels not be installed in the early stages of a job or until after the rods are already secured to another object, the channels must be cut to fit around the rods. Usually a section of channel is field cut to provide a slot for inserting the rod into the designated opening in the channel. This removed section of channel is generally then re-welded back to the channel thereby closing this slot. Furthermore, the circular ring is also installed in two semi-circular pieces which must be welded both together and to the channel.

It is thus an object of this invention to provide a means and method for installing casing support channels without the need for duplicate welding and positioning steps. It is another object of this invention to provide a one-piece plate that can be welded between the channel and the rod which will seal and/or support the channel and inner boiler casing. A further object of this invention is to provide a slotted channel thereby giving the erector the option of installing the top support casing channels at any time during the construction process. These and other objects of this invention will become obvious upon further investigation.

SUMMARY OF THE INVENTION

This invention pertains to a method of slotting a channel to its mid-region with the slot width being sized to accommodate a rod therein. This slotted channel is then positioned around suspended rods via its slot and welded in place thereby providing support for boiler casing which is later installed. An alternate embodiment of this invention pertains to supplying a grooved plate (the groove also being sized to accept the rod therein) and wedging the rod between the slot in the channel and the groove in the plate before welding the plate to both the channel and the rod.

DETAILED DESCRIPTION OF THE DRAWINGS

Figure 1:
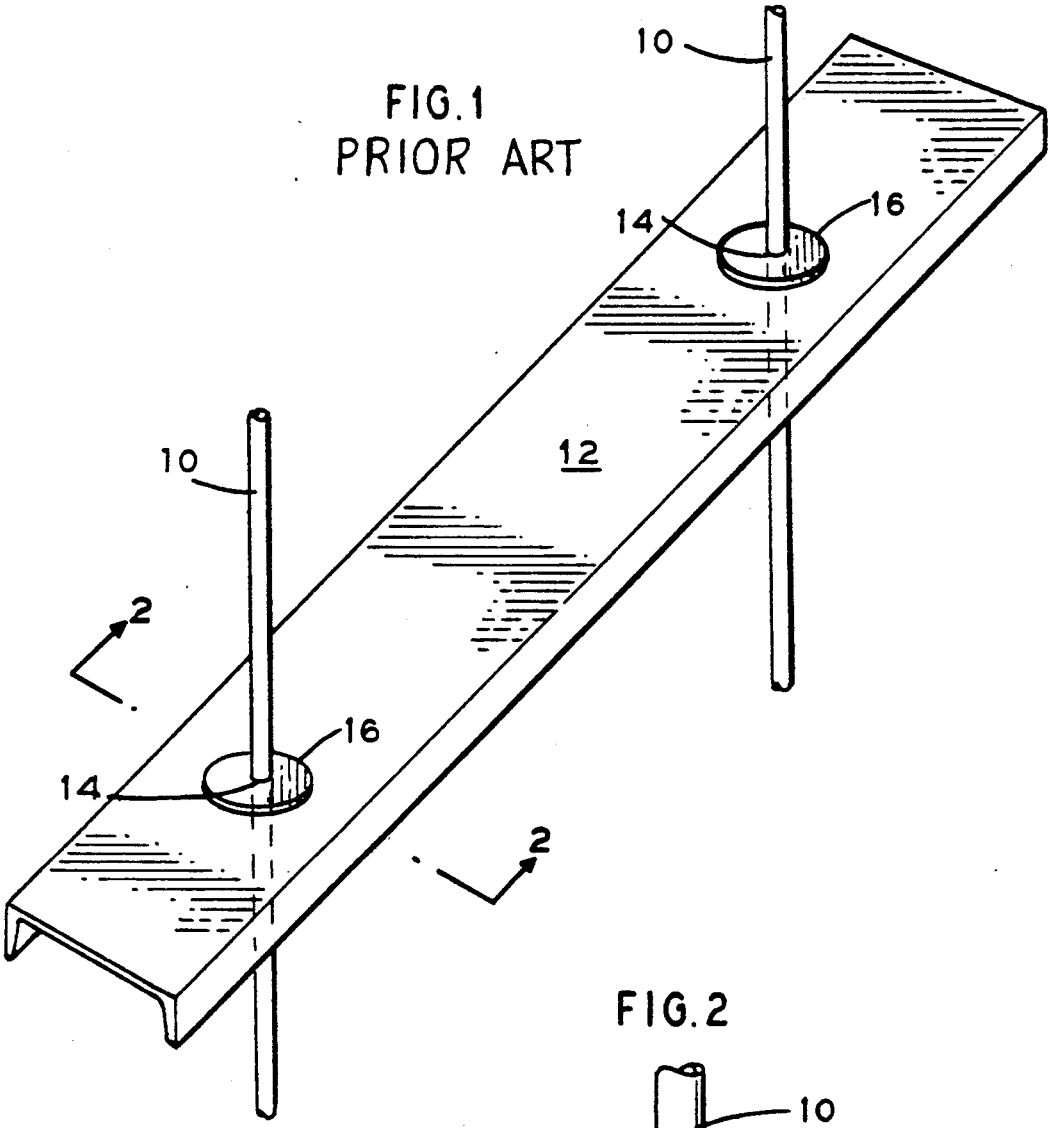
FIG. 1 PRIOR ART
FIG. 1 is a pictorial view, partially broken away, of the prior art as it pertains to supporting penthouse casing.
Figure 2:
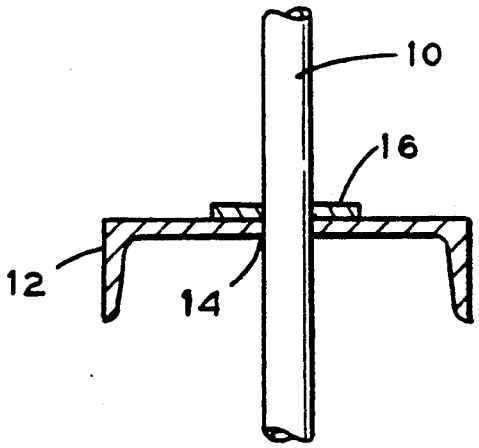
FIG. 2 is a sectional view, partially broken away, taken along lines 2—2 of FIG. 1 showing the typical method of attaching the penthouse casing support channel to the rod.
Figure 3:
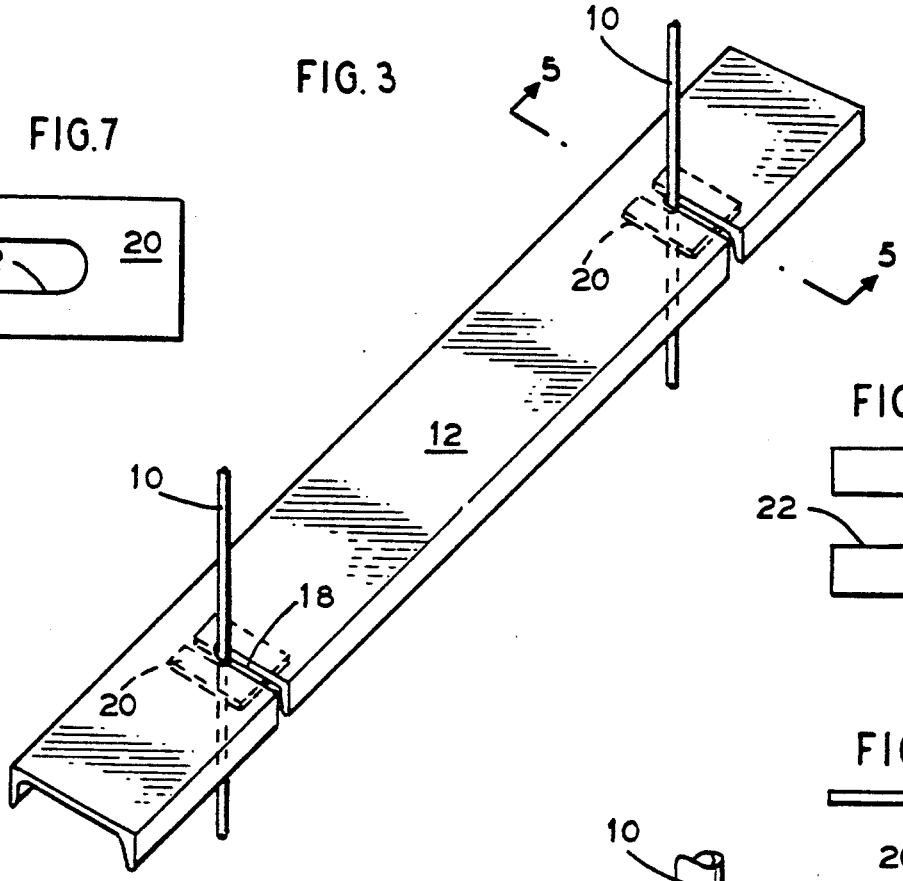
FIG. 3 is a pictorial view, partially broken away, of the invention.

Referring initially to FIGS. 1 and 2, there is disclosed the traditional or prior method of supporting penthouse casing from top support steel. Generally, threaded rods 10 with nuts would be supported from top structural steel (not shown) and hung therefrom. Channels or bearing members 12 with small openings 14 therein would then be slid upward along rods 10 and temporary supported from top steel. Usually, a seal ring 16 would be used to secure the channel to the rod by welding ring 16 both to channel 12 and rod 10. Seal ring 16 is generally designed to carry casing, insulation, live load weight, and to prevent any flue gas from escaping upward through this connection as required. When the time came to install the penthouse casing, channel 12 would be removed from a temporary support and remaneuvered down along rod 10. Once properly re-positioned, channel 12 would be welded in place as needed.

The invention contemplated herein is disclosed in FIGS. 3–7. In accordance with this invention, a slot 18 is cut in channel 12 to about its mid-point as shown. Slot 18 is sized to accommodate rod 10 so that channel 12 can now be installed at any time in the construction process. To secure channel 12 to rod 10, plate 20 is positioned either on top of or underneath channel 12 and subsequently welded thereto. Plate 20 is then secured, such as by welding, to rod 10 to complete the connection.

Plate 20 itself has a groove 22 which reaches to its mid-region and which is also sized to closely fit around rod 10. As shown, rod 10 slides within slot 18 and groove 22 with rod 10 eventually being pinched between channel 12 and plate 20. Once positioned thusly, the welding of plate 20 to both rod 10 and channel 12 occurs.

Figure 7:
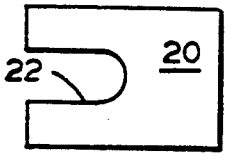
FIG. 7 is a plan view of an alternate slit plate which can be utilized in this invention.
Figure 6A:
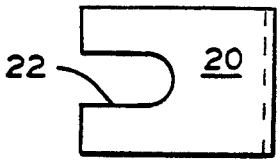
FIGS. 6*a* and 6*b* are plan and front views, respectively, of the slit plate utilized in this invention.
Figure 6B:
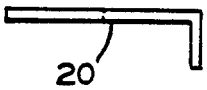
Figure 4:
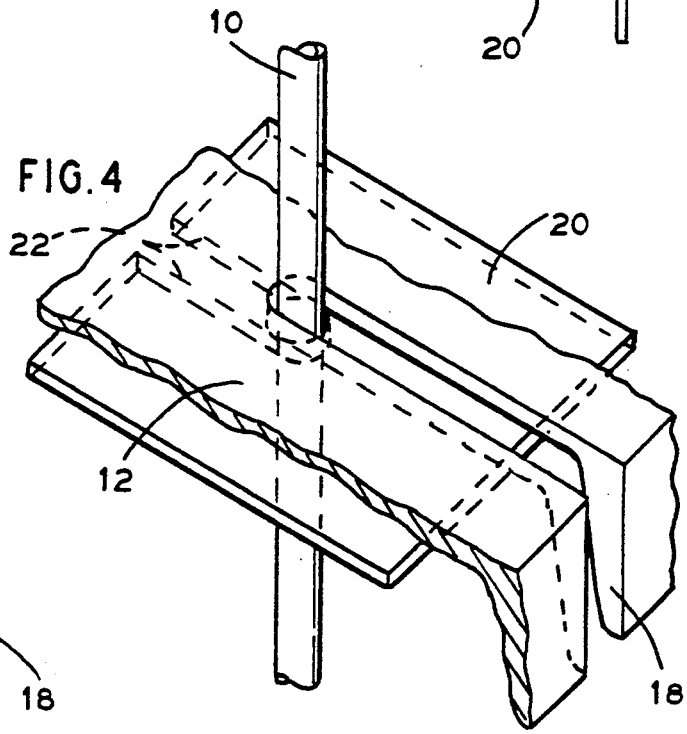
FIG. 4 is an enlarged view, partially broken away, of a portion of FIG. 3 showing the manner of connection between the penthouse casing support channel and the rod.
Figure 5:
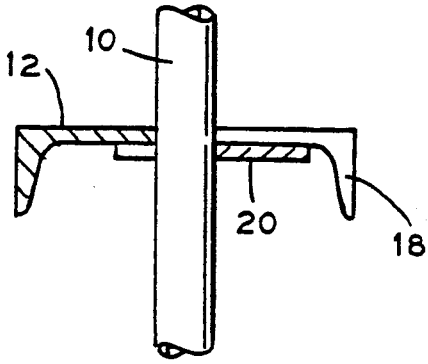
FIG. 5 is a sectional view, partially broken away, taken along lines 5—5 of FIG. 3.

Referring to FIGS. 6 and 7, plate 20 can be a flat plate or one portion of plate 20 can be bent so as to more closely conform to the underneath configuration of channel 12. Additionally, the thickness of plate can vary as needed, but generally the thickness of plate 20 is close to that of the web thickness of channel 12 for strength purposes. This is to enable channel to regain the same strength and rigidity it had before slot 18 was cut by securing bent plate 20 to channel 12.

Of course, the width of slot 18 and groove 22 can vary as needed and the spacing of slots 18 on channel 12 can be varied to accommodate the spacing of rods 10. Once channels 12 are in place, the penthouse casing and insulation can be installed thereon in the normal fashion.

What is claimed is:

1. A method of supporting boiler casing from rods secured to top support steel comprising the steps of:

a) forming a slot in a bearing member, said slot being sized to accommodate the rod therein;

b) maneuvering said bearing member around the rod via said slot;

c) positioning a plate against said bearing member and against the rod, said plate overlapping or covering said slot; and, d) securing said bearing member in place by attaching said plate to said bearing member and to the rod thereby providing a support for boiler casing.

2. The method of supporting boiler casing as set forth in claim 1 comprising the step of forming a groove in said plate, said groove being sized to accommodate the rod therein and comprising the step of sliding said plate around the rod via said groove.

3. The method of supporting boiler casing as set forth in claim 2 wherein said step of attaching said plate comprises the step of welding.

4. The method of supporting boiler casing as set forth in claim 3 wherein said bearing member is a structural channel.

5. The method of supporting boiler casing as set forth in claim 4 wherein said plate is planar and is secured to an underneath side of said channel.

6. The method of supporting boiler casing as set forth in claim 4 wherein said plate is planar and is secured to an upper side of said channel.

7. The method of supporting boiler casing as set forth in claim 4 wherein one end portion of said plate is bent at about a 90° degree angle with said bent plate being secured to an underneath side of said channel.

8. The method of supporting boiler casing as set forth in claim 7 wherein the curvature and configuration of said bent plate closely conforms to the underneath configuration of said channel.

* * * * *